US007135990B2

(12) United States Patent
Richardson et al.

(10) Patent No.: US 7,135,990 B2
(45) Date of Patent: Nov. 14, 2006

(54) MOBILE TRAFFIC LIGHT

(75) Inventors: Whitney Richardson, Valcartier (CA); Raymond Bureau, Valcartier (CA); Kevin Jack, Valcartier (CA)

(73) Assignee: Signalisation Ver-Mac Inc., Sainte-Foy ( * ) Notice: Subject to any disclaimer, the term of this patent is extended or adjusted under 35 U.S.C. 154(b) by 78 days.

(21) Appl. No.: 10/858,508

(22) Filed: Jun. 2, 2004

(65) Prior Publication Data

US 2005/0270176 A1 Dec. 8, 2005

(51) Int. Cl.
*G08G 1/095* (2006.01)

(52) U.S. Cl. ..... 340/908; 340/907; 340/332; 116/63 R; 116/63 P

(58) Field of Classification Search ..... 340/907, 340/908, 927, 930, 332, 333, 691.1, 693.2, 340/693.5, 693.9; 116/63 R, 63 P
See application file for complete search history.

(56) References Cited

U.S. PATENT DOCUMENTS 3,995,250 A 11/1976 Ferree
4,032,883 A 6/1977 Gibson
4,463,339 A 7/1984 Frick et al.
4,543,905 A * 10/1985 McKenney ..... 116/63 P
4,586,041 A 4/1986 Carlson
4,616,225 A * 10/1986 Woudenberg ..... 340/908
4,706,087 A 11/1987 Holznagel
5,185,637 A 2/1993 Lewin et al.
5,400,019 A * 3/1995 Riscoe, Jr. ..... 340/908
5,475,386 A 12/1995 Luoma
5,542,203 A 8/1996 Luoma et al.
5,805,081 A 9/1998 Fikacek
5,973,618 A 10/1999 Ellis
6,356,210 B1 3/2002 Ellis
6,750,829 B1 * 6/2004 Luoma et al. ..... 345/1.1
2003/0067399 A1 * 4/2003 Wesley ..... 340/908

* cited by examiner

*Primary Examiner*—Daryl C Pope

(57) ABSTRACT

A mobile traffic light adaptable for a solar panel. An actuated arm is provided on a platform, the actuated arm having a first member and a second member collapsible on top of each other so that they can be folded for transport. The actuated arm is lifted to provide height and reach of the device and pivoted to position the device in a desired position. A solar panel mounted to the platform is provided under the collapsed actuated arm. The solar panel also tilts and rotates.

64 Claims, 6 Drawing Sheets

MOBILE TRAFFIC LIGHT

TECHNICAL FIELD

The present invention relates to the field of signals and indicators, and more specifically, to mobile folding traffic signaling devices.

BACKGROUND OF THE INVENTION

There is often a need for temporary traffic signals, usually at a site where permanent traffic lights have not yet been installed because the area is still under construction, or because of a power outage situation in an area of high congestion. In this case, it is desirable to have a mobile traffic signal apparatus that is reliable, simple to use, and easy to deploy.

While there are many devices that exist for setting up temporarily on the side of the road, transportation to the site and deployment at the site are very important aspects of the device. There is a great need for a design that will allow a single person to deploy the apparatus once it has gotten to the site, and to facilitate the transportation of the device to the site. Stability, compactness, and safety are all issues that must be considered when designing a mobile signaling device.

In addition, there is an increasing need in this field for a traffic light apparatus that is solar powered, as this uses solar energy and cuts down on the need for electrical power, which may or may not be available at the site. The combination of a battery and a solar panel for recharging the batteries is quickly becoming the design of choice for manufacturers producing traffic signaling devices.

However, the traffic signaling devices known the art are not conceived for solar panels. The existing traffic signaling devices have been adapted for solar power by simply adding the solar panel without modifying the design of the rest of the trailer. This causes problems when the device is transported because there is no compactness or stability to the design. In addition, the design of the entire apparatus is not optimized for simplicity and convenience. Therefore, there is a need to provide a mobile traffic signaling device that is convenient to transport and easy to deploy, while being adapted to the specific needs imposed by the presence of the solar panel.

SUMMARY OF THE INVENTION

The present invention provides a mobile traffic light that can be deployed easily.

The present invention also provides a mobile traffic light that is compact and stable when it is folded for transport.

In accordance with a first broad aspect of the present invention, there is provided a mobile traffic light comprising: a platform having an attachment feature at a front end of the platform for attaching the platform to a vehicle to transport the traffic light to a desired location; an actuated arm connected to the platform and capable of receiving at least two traffic light units, the actuated arm comprising: a second member operatively connected to the platform for obtaining height; a first member operatively connected to the second member for obtaining reach; and a pivot point to swing the actuated arm out onto a portion of a road; wherein the first member and the second member collapse on top of each other and are substantially horizontal when the actuated arm is folded for transport.

In accordance with a second broad aspect of the present invention, there is provided a mobile traffic light comprising: a platform having an attachment feature at a front end of the platform for attaching the platform to a vehicle to transport the traffic light to a desired location; a powering module on the platform for powering the mobile traffic light; an actuated arm connected to a first end of the platform and capable of receiving at least two traffic light units; and a solar panel mounted substantially centrally to the platform, such that the actuated arm collapses above the solar panel when folded for transport.

In accordance with a third broad aspect of the present invention, there is provided a method for deploying a mobile traffic light, the method comprising: providing a mobile traffic light comprising: a platform having an attachment feature at a front end of the platform for attaching the platform to a vehicle to transport the traffic light to a desired location; an actuated arm connected to the platform comprising a second member and a first member operatively connected together and that can collapse on top of each other substantially horizontally when the actuated arm is folded for transport; and a pivot point; pivoting the actuated arm to set a position thereof; and lifting the actuated arm to set a height and a reach thereof.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE INVENTION

Figure 1:
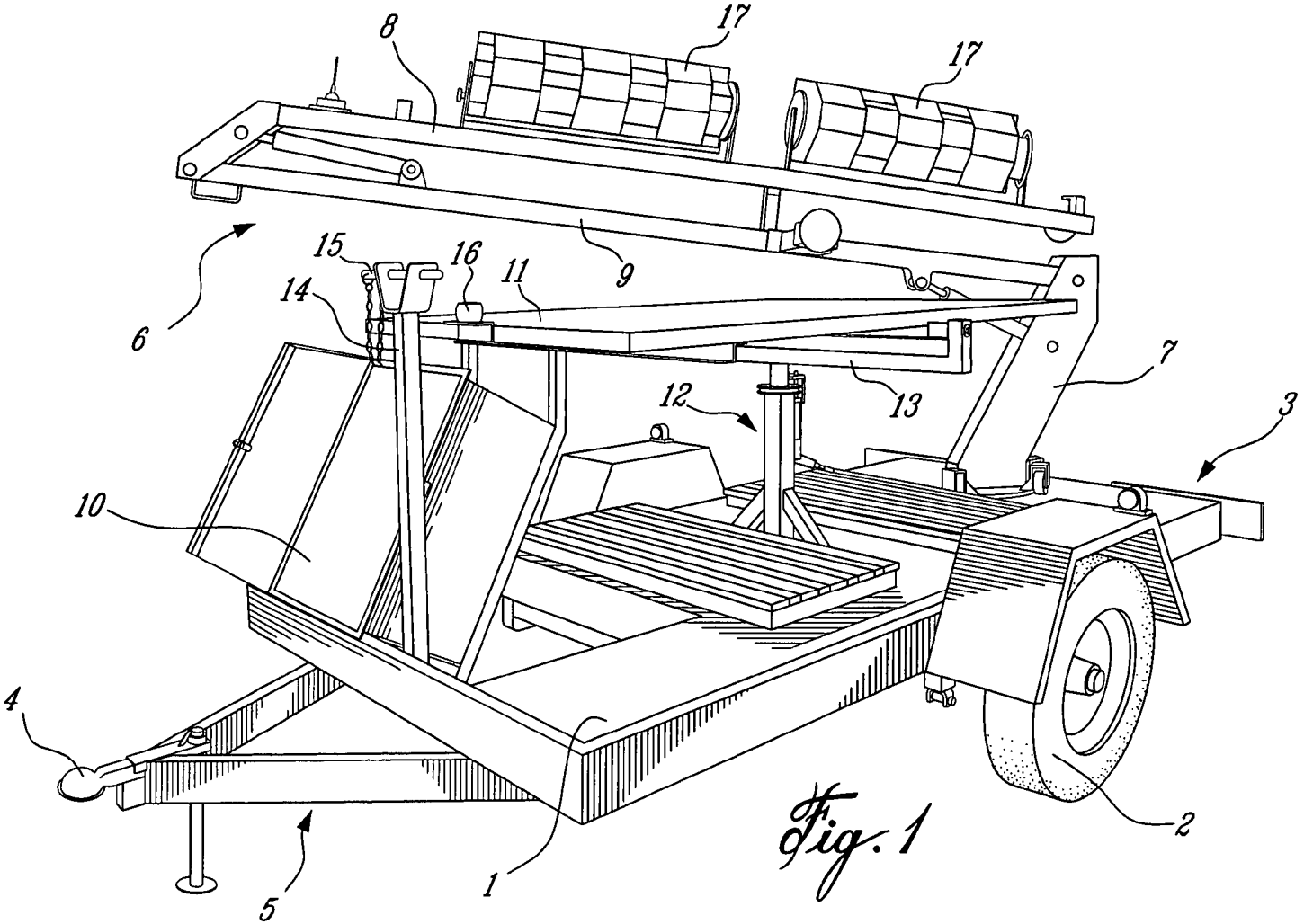
FIG. 1 is a perspective view of the mobile traffic light in a folded state in accordance with a preferred embodiment of the present invention.

FIG. 1 shows the mobile traffic light according to a preferred embodiment of the present invention. A platform 1 forms the basis of the device. Wheels 2 are provided on each side and towards the back end 3 of the platform 1. An attachment feature 4, such as a standard hitch or equivalent device, is provided at the front end 5 of the platform 1. The actuated arm 6 is mounted to the back end 3 of the platform 1. A base 7 is pivotally connected to the platform 1. The actuated arm 6 also comprises a first member 8 and a second member 9. A first end of the second member 9 is connected to the base 7. A second end of the second member 9 is connected to a first end of the first member 8. The second member 9 is for height, while the first member 8 is for reach. The two members 8,9 are collapsed on top of each other and substantially horizontal when folded for transport. The base 7 pivots the actuated arm 6 away from the platform 1 in order to position the arm 6 as desired over the road.

The arm 6 can be pivoted manually by simply gripping the end of the actuated arm 6 where the first member 8 and second member 9 are connected together and walking it to the desired position. The arm 6 is then lifted upwards, such as via a hydraulics system, electrical system, or manually. The first member 8 is then extended outwards, also by a hydraulics system, electrical system, or manually. In one embodiment, a control panel 10 is provided on the platform 1 to control the movement of the actuated arm 6.

Also on the platform 1 is a solar panel 11. In one embodiment, the solar panel 11 is mounted substantially centrally to the platform 1 such that it has enough room to pivot up and down. A mast 12 is connected to the platform 1 and a transversal bar 13 connected to the mast 12 holds the solar panel 11. The solar panel 11 can tilt and rotate. When the mobile traffic light is folded for transport, the solar panel 11 is beneath the collapsed first 8 and second 9 members of the actuated arm 6, which lock the panel 11 in place. This provides stability to the device while it is in motion, and also efficiently uses the space on the platform 1 while keeping the apparatus compact. It can be appreciated that the solar panel 11 can be mounted to the platform 1 in various ways.

An abutment feature 14 is provided at the front end 5 of the platform 1 to rest the actuated arm 6 when folded for transport. The arm 6 can extend beyond the length of the platform 1 and into the area for the attachment feature 4. The arm 6 can be locked into the abutment feature 14 using a locking mechanism 15. A pad 16 can be placed on the solar panel 11 to protect it from the actuated arm 6 when the arm 6 is locked into the abutment feature 14. The solar panel 11 is then solidly locked into place without being damaged by the actuated arm 6.

The traffic light units 17 can be mounted to either the first member 8, as shown in the figure, or the second member 9. In one embodiment, when folded for transport, the traffic light units 17 are folded down to be substantially horizontal. When being deployed, the traffic light units 17 are brought up outwardly. Alternatively, both can be folded in and out in the same direction. In one embodiment, three traffic light units 17 can be mounted to the actuated arm 6.

Figure 2:
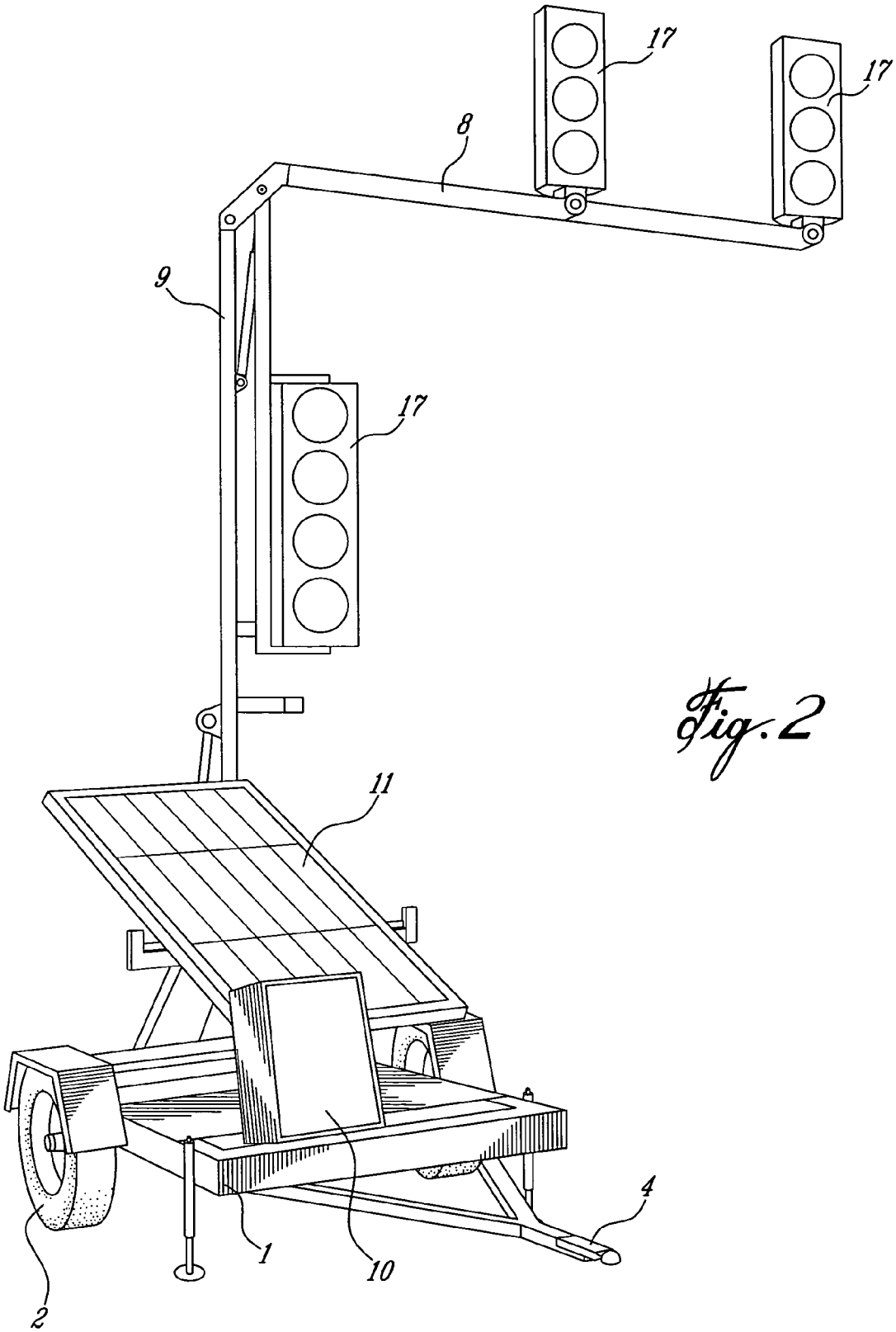
FIG. 2 is a perspective view of the mobile traffic light in a deployed state in accordance with a preferred embodiment of the present invention.

FIG. 2 shows the preferred embodiment of the present invention in a fully deployed state. The base 7 at the back end 3 of the platform 1 is pivoted to position the arm 6 above the road while having arbitrarily positioned the platform 1 on the side of the road. The second member 9 provides the height as per standard regulation requirements. The first member 8 allows the traffic light to extend across the roadway. The first member 8 may be further extended by providing a telescopic extension, or an additional member may be provided that unfolds to provide additional reach. The angle between the first member 8 and the second member 9 can be substantially 90 degrees, or another angle that will allow oncoming traffic to see the traffic light units 17 more easily.

The traffic light units 17 can stand upright on the first member 8 (perpendicular to the first member 8) and upright on the second member 9 (parallel to the second member 9). They can alternatively be positioned in opposite directions, e.g. longitudinally.

The solar panel 11 can be tilted and rotated to a desired position such that a maximum amount of solar energy is captured for a specific time of year and/or day and for a particular region. Once the panel 11 is positioned, it is locked into place to maintain it at the desired position.

Figure 3:
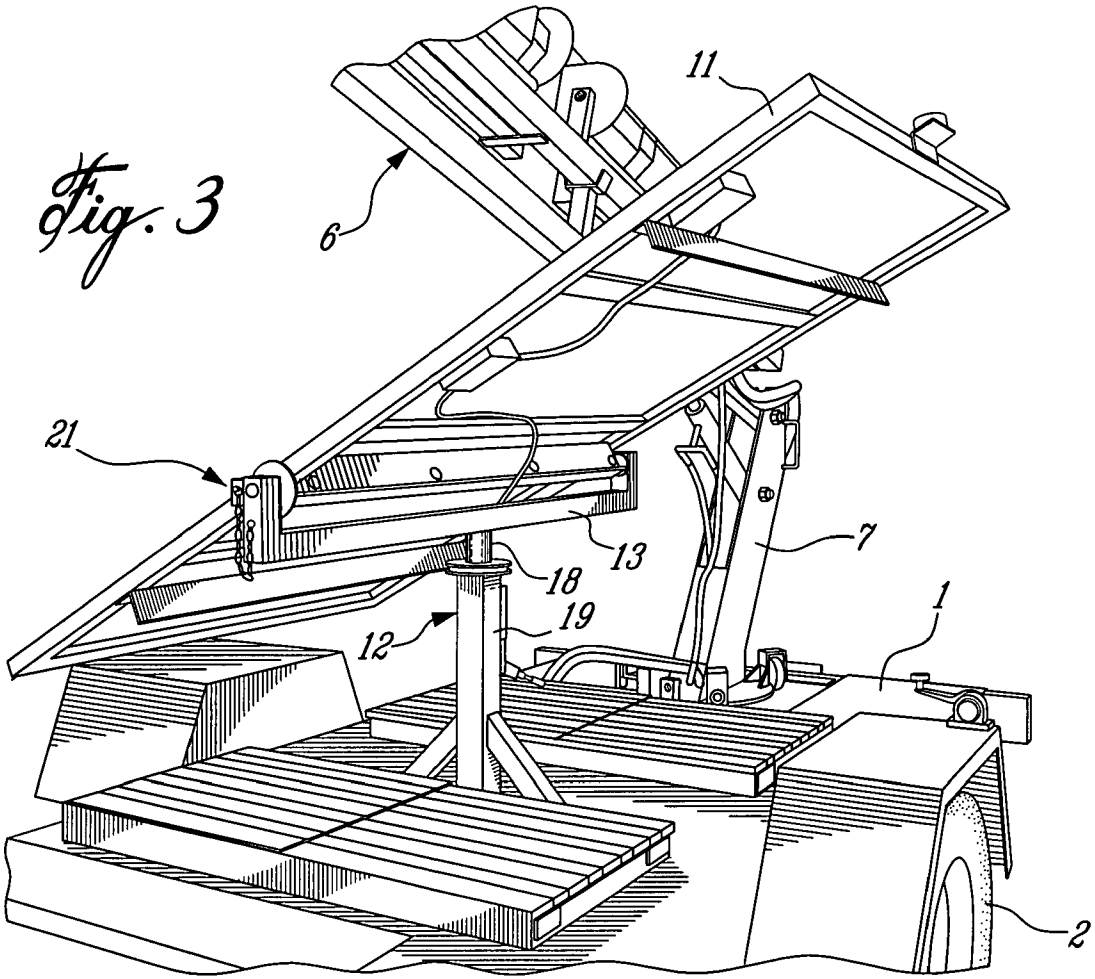
FIG. 3 is a perspective view of the solar panel in accordance with a preferred embodiment of the present invention.
Figure 4:
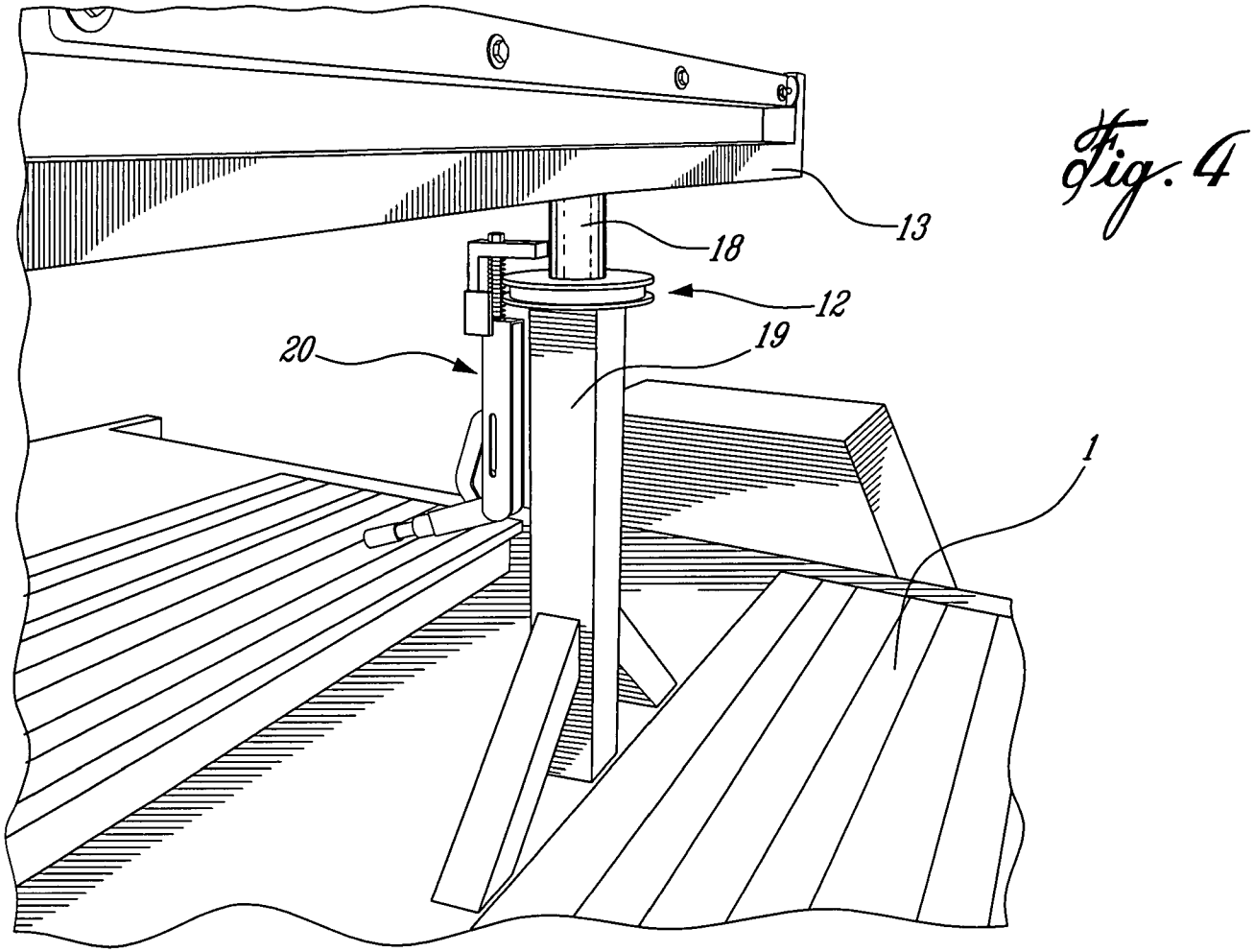
FIG. 4 is a perspective view of the clamping mechanism on the solar panel in accordance with a preferred embodiment of the present invention.
Figure 5:
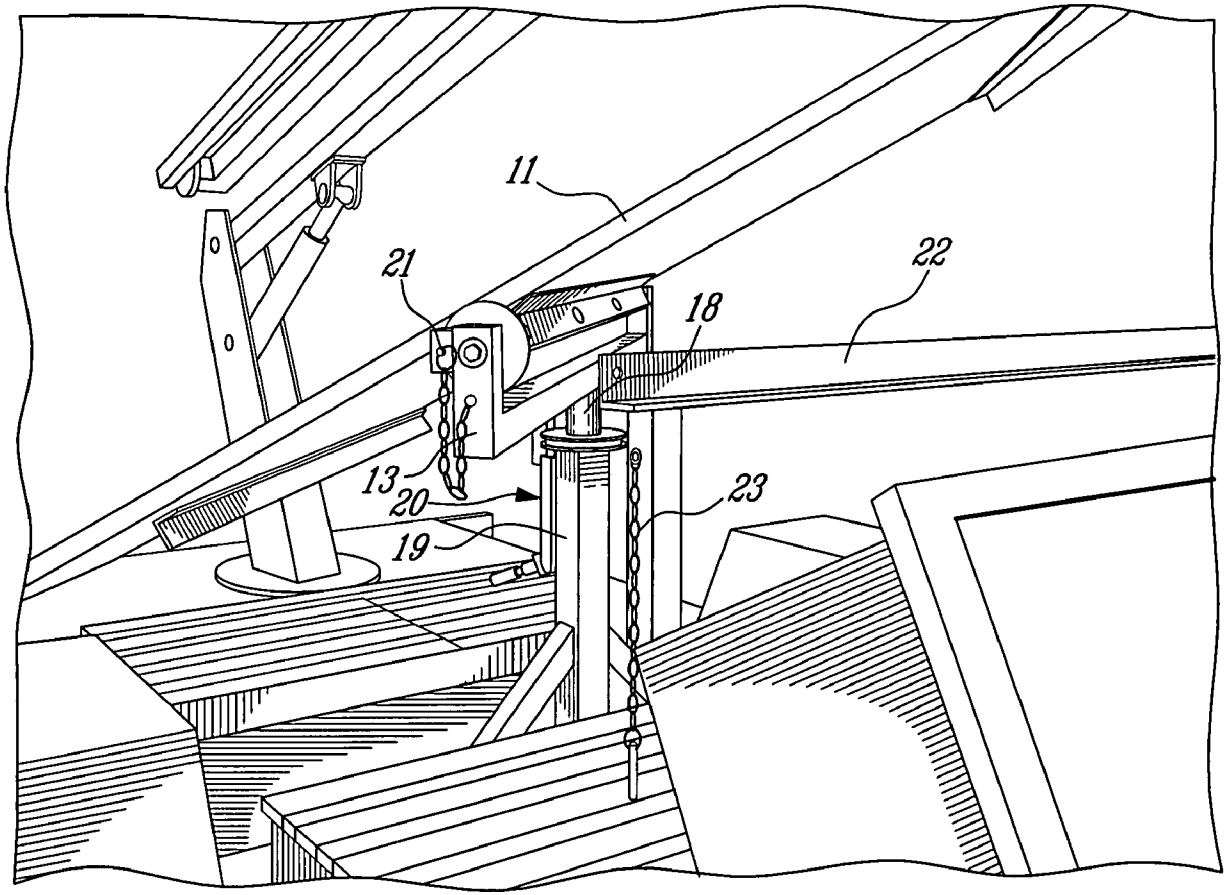
FIG. 5 is a perspective view of the pin locking mechanism on the solar panel in accordance with a preferred embodiment of the present invention.

In the preferred embodiment, the solar panel 11 is mounted to a mast 12 and transversal bar 13, which provide the tilting and rotating of the panel, as shown in FIG. 3. The mast 12 comprises an upper portion 18 rotatably engaged into a lower portion 19. The transversal bar 13, to which the panel 11 is fixed and cannot rotate about, is fixed to the upper portion 18 of the mast 12, and, when the panel 11 is rotated, the upper portion 18 rotates within the lower portion 19. The panel 11 can optionally be manually rotated. FIG. 4 shows the clamping mechanism 20 used to lock the upper portion 18 and lower portion 19 together, thereby securing the panel 11 at a desired position and preventing it from further rotating. The solar panel 11 can tilt about the transversal bar 13 and be locked into place by a pin locking mechanism 21, as shown in FIG. 5. The tilting of the panel 11 is also performed manually in one embodiment. When the panel 11 is in its initial position for storage, one end is rested onto a second transversal bar 22 to provide support for the panel 11 when locked into place. This second transversal bar 22 helps counter the weight of the actuated arm 6 on the surface of the solar panel 11 when the arm 6 is on the abutment feature 14. A pin locking mechanism 23 is also used to lock the panel 11 to the second transversal arm 22.

In accordance with a preferred embodiment, the overall length of the structure can be around 174 inches, the overall width can be around 86 inches, and the extended height can be around 198 inches. The traveling height can be around 106 inches while the operating height can be around 171 inches. The solar array within the solar panel can be adapted. An integrated solar regulator with battery surcharge protection is provided. Six-volt deep cycle batteries can also be provided to power the device. The device can be radio synchronized or quartz synchronized. Many traffic flow settings are available, as well as various user modes and pre-programmed modes. A 55-amp battery charger can also be present, as well as a 120-volt AC connection. A directional antenna, vehicle detection sensor, a cellular telephone warning system, and a countdown display are also optionally provided on the device. The device can be programmed on-site using the control panel on the platform. An automatic shut off is also provided to protect the software.

In an alternative embodiment, the second member 9 of the actuated arm 6 is connected directly to the platform 1 without a base 7. In this case, the pivot point can be provided at one of two junctions. The first is the connection point between the first member 8 and the second member 9. The second member 9 has one degree of motion at its junction point with the platform 1, and the first member 8 has two degrees of motion at its junction point with the second member 9. The first member 8 can move up and down, as well as sideways, such that the arm 6 can be pivoted towards or away from the road. In the second case, the pivot point is provided at the connection between the second member 9 and the platform 1. Two degrees of motion are provided at this junction, while only one degree is provided at the connection point between the first member 8 and the second member 9. The actuated arm 6 can then be swung out onto the road from the connection point between the second member 9 and the platform 1. In an alternative embodiment, two degrees of motion are provided at both junction points.

Figure 6:
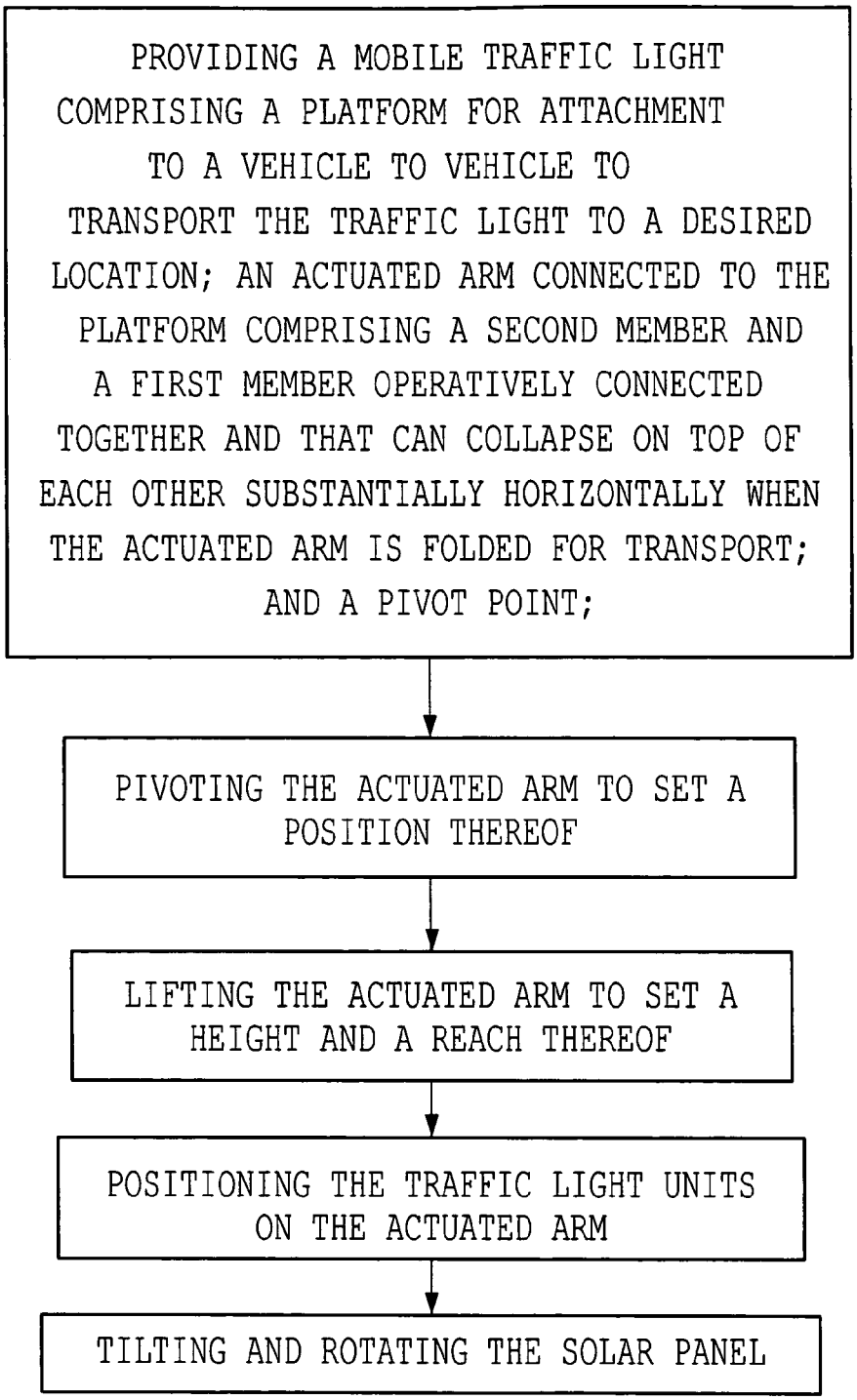
FIG. 6 is a flow chart of the method in accordance with the present invention.

FIG. 6 is a flowchart showing an exemplary method of deploying the mobile traffic light according to the present invention. The mobile traffic light has a platform 1 with attachment feature 4 at a front end 5. It also has an actuated arm 6 connected to the platform 1 comprising a second member 9 and a first member 8 operatively connected together. The first 8 and second 9 members can collapse on top of each other substantially horizontally when the actuated arm 6 is folded for transport. The actuated arm 6 has a pivot point provided thereon. The actuated arm 6 is pivoted to set a position thereof on the side of the road, and lifted to set a height and reach of the device, as desired.

In a preferred embodiment, a base 7 is pivotally connected to the platform 1, and the pivot point is at a junction between the base 7 and the platform 7. Thus, pivoting comprises pivoting the base 7 such that an end of the actuated arm 6 moves away from the platform 1. Lifting the actuated arm 6 comprises lifting the first 8 and second 9 members upwards together, and then lifting only the first member 8 outwards, such that it is substantially parallel to the ground. Lifting can also comprise lifting the arm 6 off an abutment feature 14 on the platform, and unlocking the actuated arm 6 from the abutment feature 14. In addition, the base 7 may be locked into position, and so pivoting may comprise unlocking the base 7 from a fixed position on the platform 1, pivoting the base 7, and locking it back into position. The traffic light units 17 can be positioned before the actuated arm 6 is deployed or after.

Reach and height can be increased by further extending the first 8 and second members 9. Both members 8, 9 can be made telescopically extendible. The first member 8 can also be comprised of two sub-members which are folded out to obtain additional reach.

In addition, the mobile traffic light may comprise a solar panel 11 mounted substantially centrally to the platform 1, such that the actuated arm 6 collapses above the solar panel 11 when folded for transport. The solar panel 11 may be tiltable and rotatable. Tilting of the panel 11 may comprise unlocking a pin mechanism 21 to tilt the panel, tilting the panel 11, and locking the panel 11 using the pin mechanism 21, once a desired angle has been selected. Rotating the panel may comprise unlocking a clamp mechanism 20, rotating the panel 11, and clamping the panel 11 into place once rotated to a desired position. The tilting and rotating mechanisms may be provided by alternative features and methods, as may the clamping and locking mechanisms.

The device of the present invention may be provided without a solar panel 11, but is easily adaptable for the solar panel 11, should it be required. The design is compact for traveling purposes and simple to deploy.

The embodiments of the invention described above are intended to be exemplary only. The scope of the invention is therefore intended to be limited solely by the scope of the appended claims.

We claim:

1. A mobile traffic light comprising:

a platform for attachment to a vehicle to transport said traffic light to a desired location;

an actuated arm connected to said platform and capable of receiving at least two traffic light units, said actuated arm comprising:

a second member operatively connected to said platform for obtaining height;

a first member operatively connected to said second member for obtaining reach; and a pivot point to swing said actuated arm out over a portion of a road;

wherein said first member and said second member collapse on top of each other and are substantially horizontal when said actuated arm is folded for transport.

2. A mobile traffic light as claimed in claim 1, wherein said second member is mounted to a base pivotally connected to said platform, and said pivot point is at a junction between said base and said platform.

3. A mobile traffic light as claimed in claim 2, wherein said platform comprises an abutment for resting said actuated arm when folded for transport.

4. A mobile traffic light as claimed in claim 3, wherein said abutment is connected to said platform at a front end of said platform.

5. A mobile traffic light as claimed in claim 4, wherein said abutment comprises a locking mechanism to lock said actuatcd arm into place for transport.

6. A mobile traffic light as claimed in claim 4, wherein said actuated arm extends beyond said front end of said platform when folded for transport.

7. A mobile traffic light as claimed in claim 1, wherein said platform comprises a solar panel mounted thereto for capturing solar energy.

8. A mobile traffic light as claimed in claim 7, wherein said solar panel is beneath said first member and said second member of said actuated arm folded for transport.

9. A mobile traffic light as claimed in claim 8, wherein said actuated arm locks in said solar panel when folded for transport.

10. A mobile traffic light as claimed in claim 8, wherein said solar panel is mounted substantially centrally on said platform.

11. A mobile traffic light as claimed in claim 8, wherein said solar panel is mounted to said platform by a mast and a transversal bar.

12. A mobile traffic light as claimed in claim 11 wherein said solar panel tilts about said transversal bar.

13. A mobile traffic light as claimed in claim 12, wherein said solar panel is fixed to said transversal bar member by a releasable locking pin mechanism.

14. A mobile traffic light as claimed in claim 11, wherein said solar panel rotates about said mast.

15. A mobile traffic light as claimed in claim 14, wherein said mast comprises an upper portion rotatably engaged within a lower portion.

16. A mobile traffic light as claimed in claim 15, wherein said solar panel is fixed to said mast by a clamping mechanism that locks said upper portion and said lower portion together.

17. A mobile traffic light as claimed in claim 11, wherein said mast is extendible in height.

18. A mobile traffic light as claimed in claim 1, wherein said first member is extendible in length to extend said reach.

19. A mobile traffic light as claimed in claim 18, wherein said first member is telescopically extendible.

20. A mobile traffic light as claimed in claim 1, wherein said at least two traffic light units are mounted to said first member.

21. A mobile traffic light as claimed in claim 20, wherein a third traffic light unit is mounted to said second member.

22. A mobile traffic light as claimed in claim 20, wherein said at least two traffic light units fold inwardly for transport and oatwardly for deployment.

23. A mobile traffic light comprising:

a platform for attachment to a vehicle to transport said traffic light to a desired location;

a powering module on said platform for powering said mobile traffic light;

an actuated arm connected to a first end of said platform and capable of receiving at least two traffic light units; and a solar panel mounted substantially centrally said platform, such that said actuated arm collapses above said solar panel when folded for transport.

24. A mobile traffic light as claimed in claim 23, wherein said solar panel is mounted to said platform by a mast and a transversal bar.

25. A mobile traffic light as claimed in claim 24, wherein said solar panel flits about said transversal bar.

26. A mobile traffic light as claimed in claim 25, wherein said solar panel is fixed to said transversal bar member by a releasable locking pin mechanism.

27. A mobile traffic light as claimed in claim 26, wherein said solar panel rotates about said mast.

28. A mobile traffic light as claimed in claim 27, wherein said mast comprises an upper portion rotatably engaged within a lower portion.

29. A mobile traffic light as claimed in claim 28, wherein said solar panel is fixed to said mast by a clamping mechanism that locks said upper portion and said lower portion together.

30. A mobile traffic light as claimed in claim 24, wherein said mast is extendible in height.

31. A mobile traffic light as claimed in claim 23, wherein said solar panel has an abutment pad for interfacing with said actuated arm when said actuated arm collapses above said solar panel for transport.

32. A mobile traffic light as claimed in claim 23, wherein said platform comprises an abutment for resting said actuated arm when folded for transport.

33. A mobile traffic light as claimed in claim 32, wherein said abutment is connected to said platform at a front end of said platform.

34. A mobile traffic light as claimed in claim 33, wherein said abutment comprises a locking mechanism to lock said actuated arm into place for transport.

35. A mobile traffic light as claimed in claim 34, wherein said actuating arm extends beyond said front end of said platform when folded for transport.

36. A method for deploying a mobile traffic light, the method comprising:

providing a mobile traffic light comprising:

a platform for attachment to a vehicle to transport said traffic light to a desired location;

an actuated arm connected to said platform comprising a second member and a first member operatively connected together and that can collapse on top of each other substantially horizontally when said actuated arm is folded for transport; and a pivot point;

pivoting said actuated arm to set a position thereof; and lifting said actuated arm to set a height and a reach thereof.

37. A method as claimed in claim 36, wherein said providing comprises mounting said second member to a base pivotally connected to said platform, and providing said pivot point at a junction between said base and said platform, and wherein said pivoting comprises pivoting said base such that an end of said actuated arm moves away from said platform.

38. A method as claimed in claim 37, wherein said lifting comprises lifting said first and second members upwards, and lifting said first member outwards.

39. A method as claimed in claim 38, wherein said lifting comprises lifting said actuated arm off an abutment on said platform.

40. A method as claimed in claim 39, wherein said lifting comprises unlocking said actuated arm from said abutment.

41. A method as claimed in claim 37, wherein said pivoting said base comprises unlocking said base from a fixed position on said platform.

42. A method as claimed in claim 36, further comprising positioning said traffic light on said actuated arm.

43. A method as claimed in claim 37, wherein said pivoting said base comprises manually pivoting said base.

44. A method as claimed in claim 36, wherein said lifting comprises lifting with a hydraulics system.

45. A method as claimed in claim 38, wherein said lifting said first member outwards comprises extending said first member to increase its length.

46. A method as claimed in claim 36, wherein said providing a mobile traffic light comprises providing a solar panel mounted substantially centrally to said platform, such tat said actuated arm collapses above said solar panel when folded for transport.

47. A method as claimed in claim 46, further comprising tilting said solar panel to a desired angle.

48. A method as claimed in claim 47, wherein said tilting comprises unlocking a pin looking mechanism to tilt said solar panel.

49. A method as claimed in claim 48, wherein said tilting comprises locking said solar panel at said desired angle.

50. A method as claimed in claim 46, further comprising rotating said solar panel to a desired position.

51. A method as claimed in claim 50, wherein said rotating comprises unlocking a clamping mechanism to rotate said solar panel.

52. A method as claimed in claim 51, wherein said rotating comprises clamping said solar panel at said desired position.

53. A method as claimed in claim 46, further comprising tilting and rotating said solar panel to a desired position.

54. A method as claimed in claim 53, wherein said tilting and rotating comprises unlocking said solar panel from a fixed position, tilting and rotating to said desired position, and locking said solar panel at said desired position.

55. A mobile traffic light as claimed in claim 1, wherein said platform comprises attachment means for attaching said platform to the vehicle.

56. A mobile traffic light as claimed in claim 23, wherein said platform comprises attachment means for attaching said platform to the vehicle.

57. A method as claimed in claim 36, wherein said providing comprises providing an attachment means at a front end of said platform for attaching said platform to the vehicle.

58. A mobile traffic light apparatus comprising a first member operatively connected to a strut and to a second member, said strut pivotally connected to a wheeled platform wherein said first member and said second member are adaptable to substantially horizontally collapse when said apparatus is prepared for transport.

59. The apparatus of claim 58, wherein said first member is pivotally mounted to said strut.

60. The apparatus of claim 58, wherein said first and second members are independently extendible of each other.

61. The apparatus of claim 58, further comprising a solar panel operatively mounted thereto.

62. The apparatus of claim 61, wherein said solar panel is adaptable to substantially horizontally collapse when said apparatus is prepared for transport.

63. The apparatus of claim 58, further comprising at least one traffic light unit mounted to said second member.

64. The apparatus of claim 63, further comprising a traffic light unit mounted to said first member.

* * * * *